United States Patent [19]

Evans

[11] 3,944,185

[45] Mar. 16, 1976

[54] HOIST APPARATUS

[75] Inventor: Michael J. Evans, Los Angeles, Calif.

[73] Assignee: Mayco Equipment Co., Inc., Los Angeles, Calif.

[22] Filed: June 28, 1974

[21] Appl. No.: 483,981

[52] U.S. Cl. ..... 254/175.5; 187/20; 254/191

[51] Int. Cl.[2] ..... B66D 1/76

[58] Field of Search ..... 254/175.5, 175.7, 191, 254/167, 168, 149; 187/11, 20

[56] References Cited

UNITED STATES PATENTS

| | | | |
|---|---|---|---|
| 3,100,626 | 8/1963 | Good | 254/175.5 |
| 3,231,240 | 1/1966 | Naito | 254/191 |
| 3,520,515 | 7/1970 | Pomagaski et al. | 254/175.5 |
| 3,524,626 | 8/1970 | Pomagalski et al. | 254/175.5 |
| 3,721,426 | 3/1973 | Kaufer | 254/175.5 |
| 3,729,173 | 4/1973 | Levardon | 254/175.5 |

*Primary Examiner*—Robert J. Spar
*Assistant Examiner*—Lawrence J. Oresky
*Attorney, Agent, or Firm*—George J. Netter

[57] ABSTRACT

The hoist includes a rotatably mounted drive sheave having a continuous circumferential groove within which the load cable is received. A flexible bandlike member extends about the cable on the sheave, and has both ends connected via linkages to an eccentrically mounted bell crank on an auxiliary sheave. One cable end, after passing around the drive sheave, engages a portion of the auxiliary sheave circumference, translating the auxiliary sheave eccentrically and pulling both ends of the bandlike member when the cable is loaded.

13 Claims, 10 Drawing Figures

3
11
19
18
26
17
48
35
5
32
38
5
33
37
36
39
34
31
27
40
42
21
20
24
41
29
30
25
29
23
28
60
22
63
64
61
75
62
11
d
12
16
3

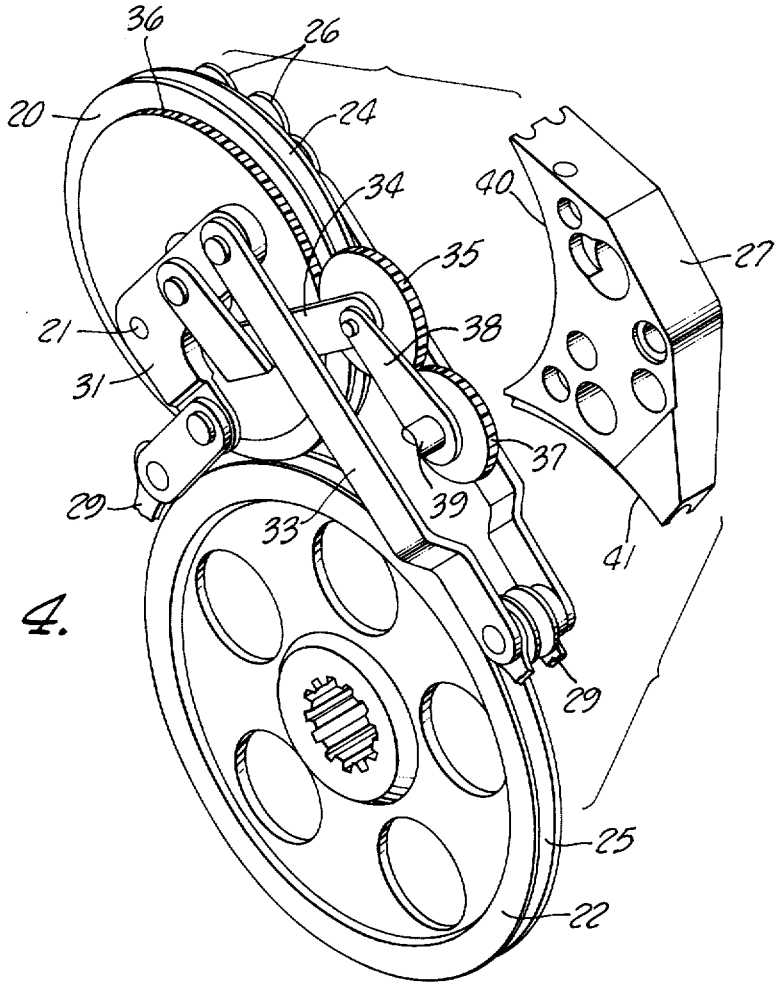
FIG. 4.
FIG. 5.
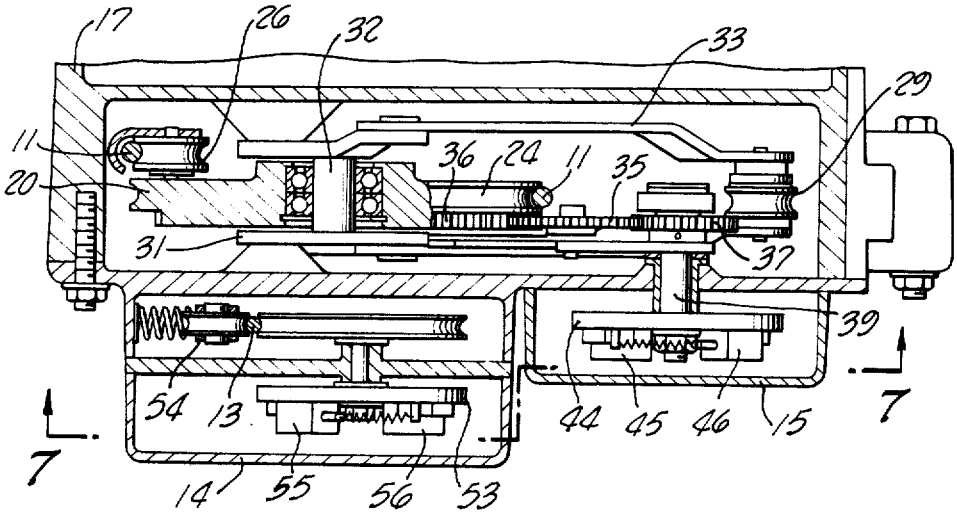

HOIST APPARATUS

The present invention relates generally to hoist apparatus for raising or lowering a load connected to a cable, and, more particularly, to hoist apparatus having a driving pulley interrelated with the cable in such manner that driving pressure on the cable varies in accordance with the load.

OBJECTS AND SUMMARY OF THE INVENTION

It is a primary object and aim of the subject invention to provide cable drawing apparatus of improved construction for providing efficient and controlled handling of the cable and load carried thereby with uniform driving force being applied along the engaged portion of the cable which increases as the load increases.

A further object of the invention is the provision of cable hoist apparatus including a driving sheave and a flexible beltlike member received thereabout for exerting a retaining force onto a cable being driven by the sheave, both ends of which member are subjected to simultaneous sheave forces by the cable load.

A still further object of the invention is the provision of hoist apparatus as in the above objects which is simple to operate, easy to service and maintain, and exceptionally safe and reliable in use.

In summary of the apparatus of the invention, there is provided a hoist apparatus including a rotatably mounted drive sheave, including a continuous circumferential groove within which the load cable is received. A flexible bandlike member extends about the cable on the sheave, and has both ends connected via linkages to an eccentrically mounted bell crank on an auxiliary sheave. One end of the cable, after passing around the drive sheave, engages a portion of the circumference of the auxiliary sheave in such a manner as to translate the auxiliary sheave eccentrically, thereby applying a pulling force simultaneously to both ends of the bandlike member when a load is applied to the cable. Tension of the bandlike member is also applied in a uniform manner about the periphery of the drive sheave radially onto the cable, maintaining it in full driving relation with the sheave.

DESCRIPTION OF THE DRAWINGS

FIG. 4 is a perspective view of the drive sheave, tensioning bell crank, and associated linkage.

FIG. 5 is a plan, sectional view taken along line 5—5 of FIG. 2.

DESCRIPTION OF A PREFERRED EMBODIMENT

Figure 1:
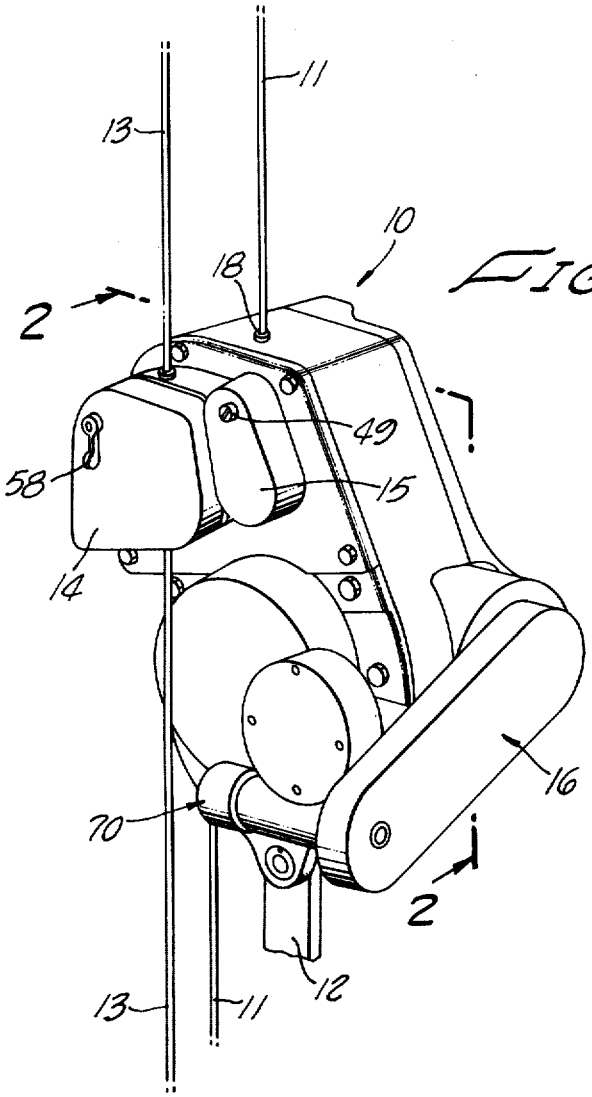
FIG. 1 is a perspective view of the hoist apparatus of this invention shown mounted in driving relation onto a cable and connected to a load.

Turning now to FIG. 1 there is illustrated, in perspective view, the hoist apparatus of this invention identified generally as 10, which is drivingly related in a way to be described, to a cable 11 for moving a load interconnected therewith via a mounting bar 12. Customarily, a separate cable such as the cable 13 passes through a safety braking means 14 unitary with the hoist apparatus and which serves to automatically brake movement with respect to the cable 13 in the event of the cable moving therethrough at an excessive rate such as could occur on severance of the cable 11. More particularly, a further safety brake 15 is interconnected with the cable 11 to stop descent in the event downward velocity exceeds some predetermined maximum. The latter brake is particularly useful if the hoist apparatus and attached load should be lowered beyond the end of cable 11, at which time due to disengagement of the driving mechanism and the cable, there will be a momentary sharp increase in downward velocity and the brake will be immediately actuated.

The hoist apparatus 10 also includes motor drive means 16 which drivingly engages the cable 11 for lifting, lowering or otherwise moving the load connected at 12. Although innumerable types of loads may be handled by the apparatus of this invention, one general application is that of raising and lowering scaffolding carrying personnel and equipment in or along the face of a building, for example.

Figure 2:
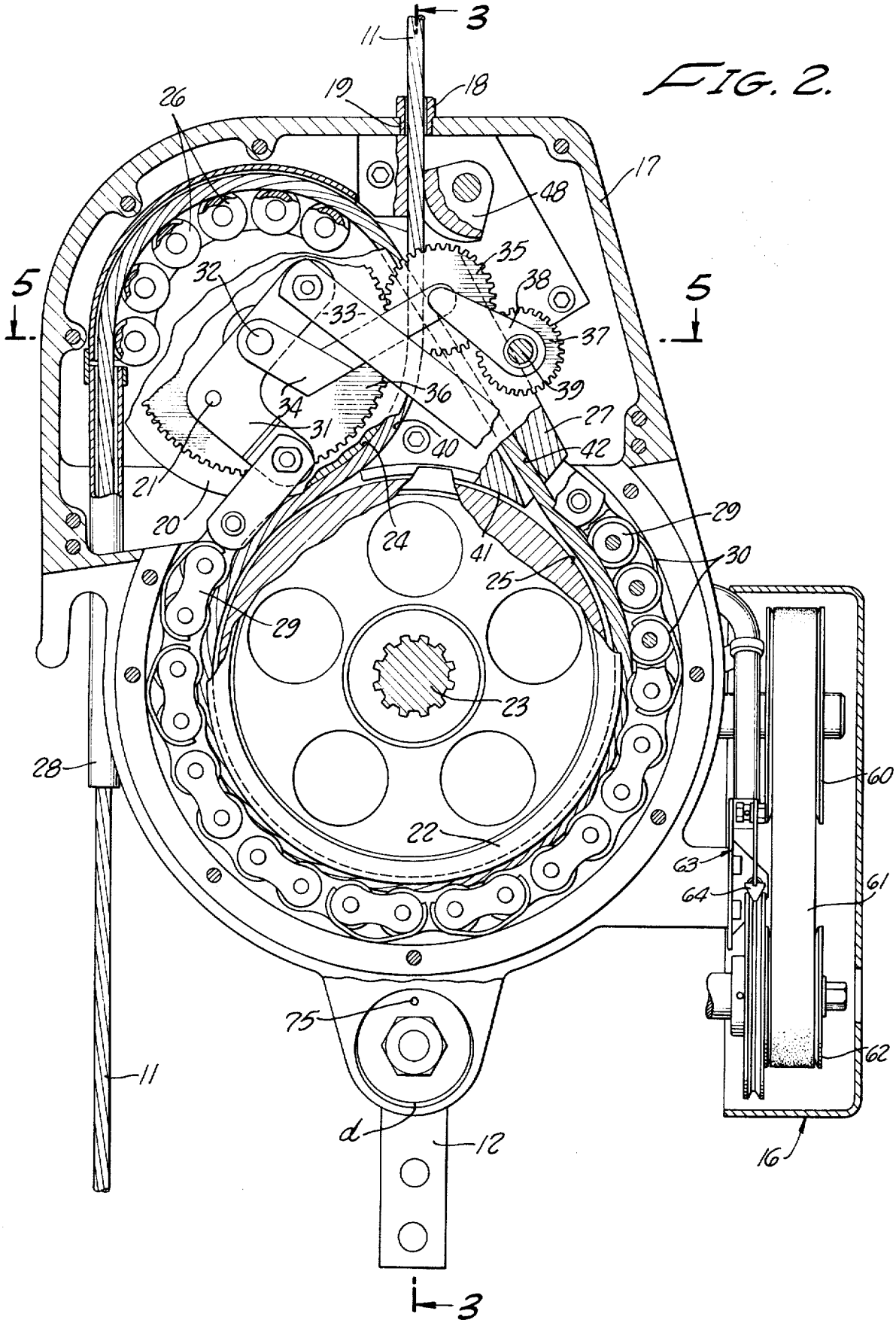
FIG. 2 is a side elevational sectional view of the apparatus of FIG. 1 taken along the line 2—2.

With reference now to FIG. 2, the entire hoist apparatus is seen to be enclosed within a housing or casing 17 which may be constructed of aluminum, for example. The cable 11, fixedly connected to some stable point on a building, for example, passes down through an oversize bushing 18 received within an accommodating opening 19 in the upper wall of the housing. An auxiliary or tensioning sheave 20 is mounted in the upper regions of the housing adjacent the opening 19 for eccentric pivoting motion about an axis 21 affixed to the housing. A second or driving sheave 22 of substantially larger diameter than the sheave 20 is also mounted within the housing 17 for rotation about a central axle 23 interconnected with the motor drive means 16. The two sheaves are mounted with their circumferential peripheries in substantially the same plane and each includes a peripheral groove (24 in the sheave 20, and 25 in the sheave 22) for receiving the cable 11 therein. A plurality of circular rollers 26, having grooved peripheries, are rotatably mounted to the back side of the sheave 20 with the grooves forming an arcuate path generally coextensive with the edge of the sheave 20.

The cable 11, as shown in FIG. 2, after entering via the bushing 18, is received in the peripheral groove of that portion of the sheave 20 facing the drive sheave 22, then passes almost completely around groove 25, is guided by a diverter 27 to the grooved peripheries of the rollers 26, after which it leaves the housing 17 through guide tube 28. For a purpose that will be expanded upon later, exertion of a tensile force on the cable 11 produces an eccentric swinging movement of the sheave 20 away from drive sheave 22.

Encompassing approximately 270° of the driving sheave periphery, is a flexible pressure exerting member or chain 29, constructed of a plurality of individual roller links having grooved peripheries adapted for engaging the outwardly directed surface of the cable 11 when it is received in the groove of sheave 22. The rollers forming each link are associated in pairs with some or all having a generally C-shaped leaf spring 30 snapped thereover, the outer portion of which engages the inner wall of the housing 17, serving to resiliently urge the member 29 inwardly into contacting relationship with the cable 11. In this manner, continuous contacting relation between the member 29 and the cable 11 is maintained throughout.

Still referring to FIG. 2, a generally L-shaped bell crank 31 is rotatably mounted onto the sheave 20 via an axle 32 at substantially the midpoint of one of its arms. The other arm of the bell crank extends toward the sheave 20 and has its extremity rotatably connected to the end of the member 29, while the opposite end of the bell crank has a transfer arm 33 rotatably connected therewith as well as being connected to the remaining end of the member 29. Rotation of the bell crank counter-clockwise about 21 (which is affixed to the housing as it is depicted in FIG. 2) accordingly produces a pulling force on both ends of the member 29 substantially tangential to the sheave periphery. That is, rotation of the bell crank in a counter-clockwise direction which is associated with an increase in load on the cable 11, causes the member 29 to tighten about the outer surface of the cable, compressing it into the groove on the sheave 22. Rotation of the bell crank in the opposite direction, of course, loosens the retaining force of the member 29 on the cable 11.

Turning now to both FIGS. 4 and 5 and the more detailed features of the tension controlled cable drive means, the sheaves 20 and 22 are shown arranged with their grooved peripheries in opposed relationship. The bell crank 31 is pivotally secured to the housing 17 via the axle 21 and has it one arm pivotally connected to an end of the chain member 29 29 through the elongated lever 33. The axle about which the sheave 20 rotates is rotatably received within the end of an L-shaped bracket 34. The other end of bracket 34 rotatably supports an idler gear 35 which is meshed with a set of gear teeth 36 carried by the sheave 20. A further gear is drivingly interconnected with the gear 35 by the arm 38, whereby rotation of the sheave 20 is transmitted to the gear 37 for rotating the shaft 39. It is clear that this rotative driving relation between the sheave and shaft 39 will be maintained irrespective of the location of the sheave 20 with respect to the eccentric axis 21. That is, movement of the cable 11 through the apparatus not only will produce a levering movement of sheave 20 in a direction toward and away from sheave 22, but also will rotate the sheave 20, producing a corresponding rotation of the shaft 39 for a purpose to be described.

The diverter 27 (FIG. 4) is a one-piece construction which is affixed to the interior wall of the housing by conventional threaded means, for example, and has curved portions 40 and 41 which conform to the peripheries of sheaves 20 and 22, respectively. An opening 42 extending completely through the body of the diverter receives the cable 11 therewithin and serves both as a guide for the cable and as a means for maintaining the cable within the peripheral sheave grooves. More particularly, the diverter includes a first generally vertical passage 43 for receiving the incoming cable and directing it to the grooved periphery of sheave 20, and a second passage 42 which guides the cable between the rollers 26 and the sheave 22.

Figure 7:
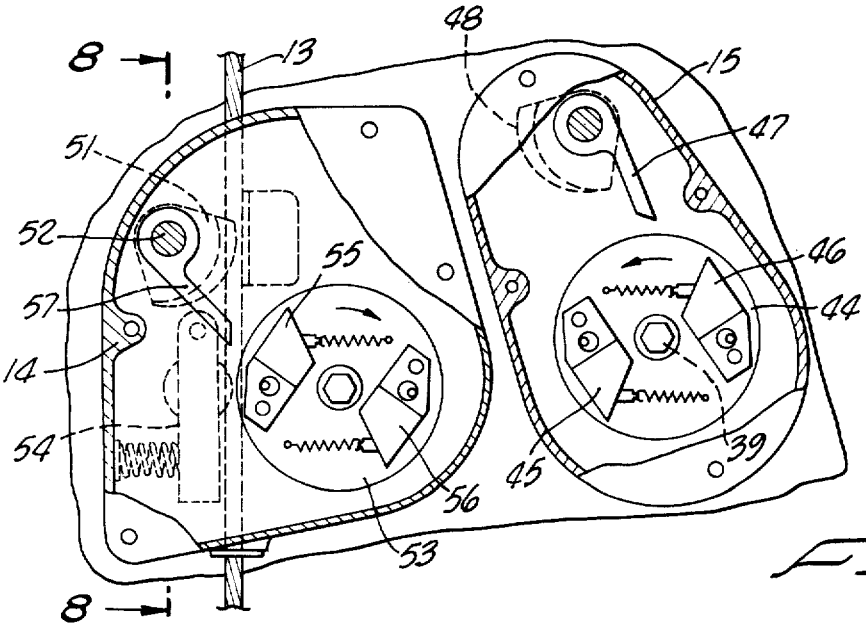
FIG. 7 is a sectional elevational view of a velocity actuated safety brake interrelated with the hoist apparatus taken along line 7—7 of FIG. 5.

With reference simultaneously to FIGS. 5 and 7, a description of the safety braking system 15 associated with the cable 11 will now be given. The shaft 39, driven by rotation of the sheave 20 as already described, extends via a coupling through the housing wall and is fixedly secured to a drive plate 44 which is rotated thereby. A pair of spring-loaded pawls 45 and 46 pivotally mounted on the outwardly facing surface of the drive plate 44 have portions which move beyond the periphery of the drive plate when it is rotated (in the direction of the arrow in FIG. 7) at a rate exceeding some predetermined velocity to engage the brake actuation arm 47. Turning the arm 47 clockwise as it is depicted in FIG. 7 moves an over-center spring plunger for positively moving an eccentric braking cam 48 against the cable 11 (FIG. 2), thereby gripping the cable between the cam and a stop member (not shown) braking its movement through the assembly. Resetting of the braking system 15 is accomplished simply by manipulation of the external control 49, which removes the cam 48 from contacting relation with the cable 11, thereby freeing it. Although the braking system 15 is actuated whenever the cable 11 moves through the apparatus in excess of a prescribed velocity for whatever reason, it is contemplated that it will be most usefully applied when the lower end of the cable has completely run through the sheave 22 and is disengaged therefrom, at which time the sheave 20 and thus the braking system axle 39 experiences a rapid increase in rotative velocity actuating the braking system and securing the cable end portion.

The auxiliary braking system 14 operates in a manner very similar to the braking system 15 just described. The cable 13 extends downwardly between a stop member and braking cam 51 mounted for eccentric rotation about axis 52. Next, the cable contacts the periphery of a disklike plate 53 rotatably mounted to the housing. A spring-loaded drive member 54 continuously urges the cable 13 against the plate periphery so that movement of the cable rotates the plate. Rotation of the plate 53 is the direction shown (i.e., the apparatus is moving downward) in excess of a predetermined speed causes the spring-loaded pawls 55 and 56 to extend beyond the plate edge and drive the lever arm 57 counter-clockwise, which clamps the cable between the cams 51 and the stop 50. Release from a "braked" or "stop" position is simply accomplished by rotating the control 58 (FIG. 1) with a screw driver which moves the cam 51 away from the cable.

Figure 6:
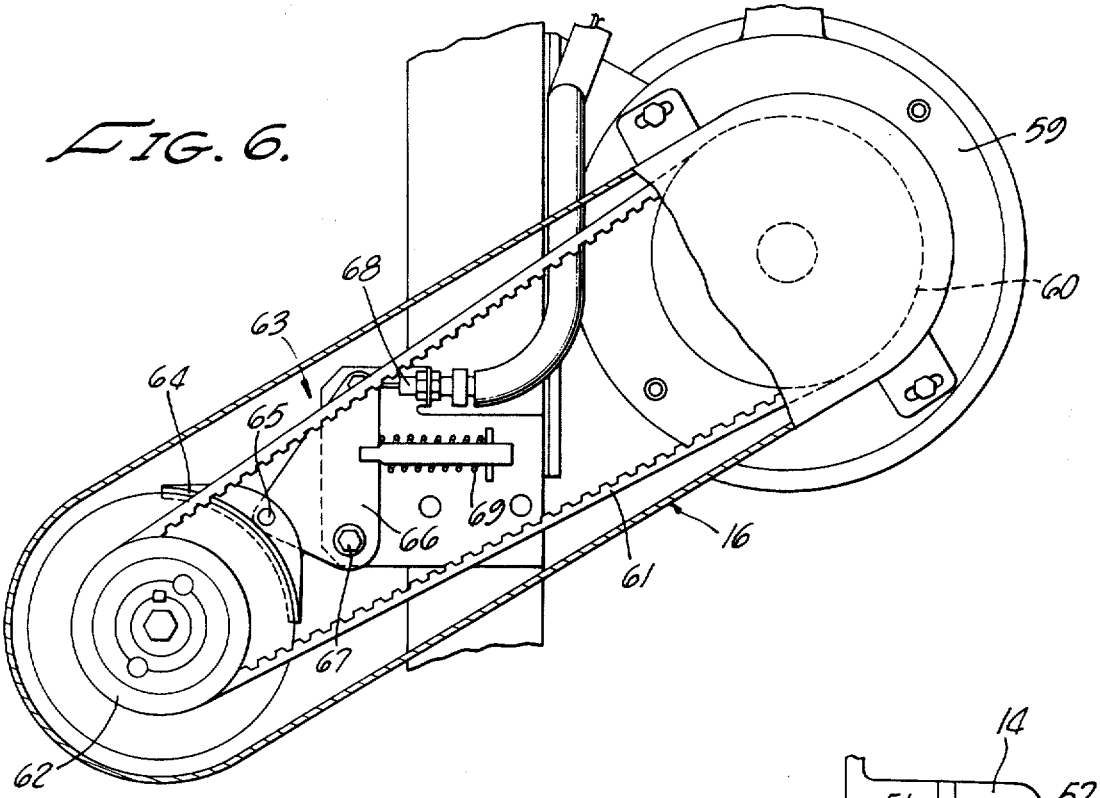
FIG. 6 is a sectional, elevational view of the power drive train.
Figure 10:
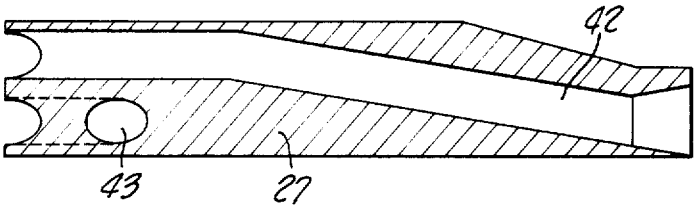
FIG. 10 is a sectional view of the cable diverter.
Figure 8:
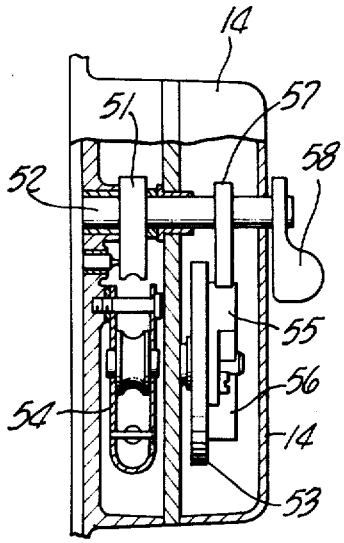
FIG. 8 is a further sectional view of the safety brake taken along line 8—8 of FIG. 7.

With reference now to FIG. 6, the power train is seen to include a conventional electric motor 59, a drive sheave 60 having a notched or toothed periphery, and a toothed drive belt 61 received on the sheave 60 and on a drive sheave 62. The driven sheave interconnects through a worm gear arrangement with the axle 23 to impart rotation to the sheave 22 (FIG. 2).

The use of a worm drive will prevent back rotation of the power supply elements when the apparatus is stopped and a load of moderate size is being supported. However, to insure against back movement of the apparatus and supported load during no-power conditions, there is provided a wedge brake 63 (FIG. 6) which applies a braking force onto the sheave 62 whenever the electric power is interrupted to the motor 59. Specifically, the brake 63 includes a brake shoe 61 pivotally interconnected to one corner 65 of a triangular drive plate 66. The plate 66 is rotatably mounted adjacent the sheave 62 as at 67, and means 68 is powered to move the shoe 64 out of braking relation (to the right as depicted in FIG. 6). When power is removed, the means 68 is quiescent and the coil spring moves the plate 65 to the left, thereby engaging the brake shoe 64 with the sheave 62.

Figure 9:
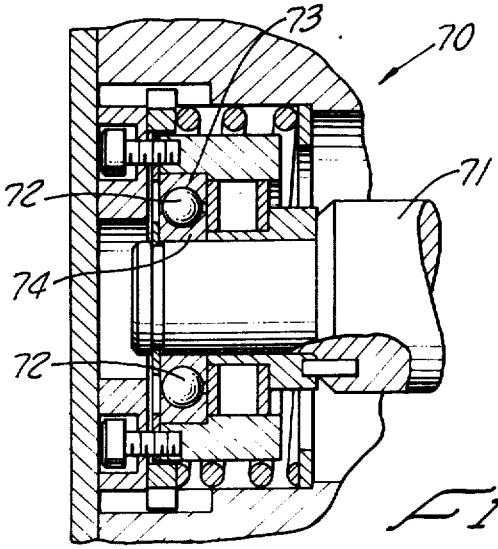
FIG. 9 is a sectional, fragmentary view of a one-way drag assembly.

Furthermore, to assist against back rotation during powered operations and particularly when a heavy load is being handled, a so-called drag clutch 70 is connected to the end of the worm gear shaft 71. Essentially, the drag clutch provides low resistance to rotative motion in the direction for lifting the load and a substantially increased resistance for rotation in the reverse direction. Accordingly, a load may be lifted to any predetermined height and the motor 59 turned off and the load will be maintained supported with no back motion or slippage occurring through the power train due to the combined operation of the wedge brake 53 and drag clutch 70. The drag clutch may be of conventional construction such as depicted in FIG. 9 where bearings 72 for the shaft 71 have shiftable beveled race elements 73 and 74 such that rotation of the shaft in one direction moves the beveled race elements apart, allowing free rotation of the bearings, whereas rotation in the opposite direction closes the race elements slightly to restrict bearing rotation.

Figure 3:
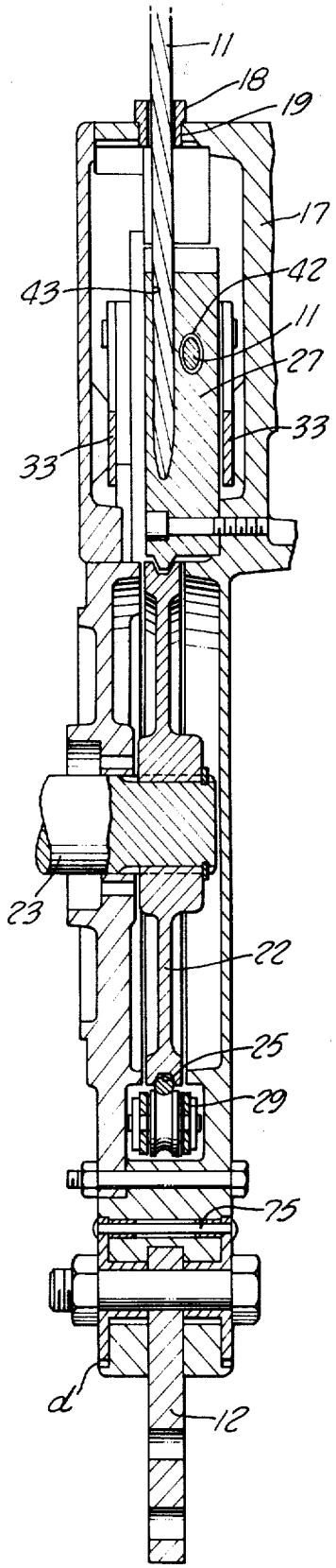
FIG. 3 is a further elevational sectional view of the apparatus taken along the line 3—3 in FIG. 2.

As a further aspect of the invention, in the event that an attempt is made to handle a load which is beyond the rated capacity of the equipment, a visual indication is provided of the overloaded condition. That is, as is shown in FIGS. 2 and 3, a pin 75 is supportingly related to the member 12, and which pin is so constructed that it will break upon being subjected to a load greated than the predetermined rated load of the equipment. When the pin 75 breaks, this causes the member 12 and associated parts to extend downwardly the additional distance *d*, providing the desired overloading indication. Additional marking, i.e., colored indicia, may be applied which is uncovered when the pin breaks.

What is claimed is:

1. Powered hoist apparatus for moving a load along a cable, comprising:

a first disclike member drivingly connected to a source of rotative power, said member having a grooved circumferential periphery within which the cable is received;

a second disclike member having a grooved circumferential periphery within a part of which the cable is received, said second member being rotatably mounted adjacent the first member in the same plane therewith and arranged for eccentric pivotal movement about an axis toward and away from said first member;

roller means having grooved peripheries rotatably mounted on said second disclike member for receiving the cable therewithin, the roller means grooved peripheries forming an arcuate path offset from and generally parallel to the grooved periphery of said first disclike member;

a resilient pressure applying means received about said first member contactingly engaging the cable received within the first member periphery and having first and second end portions; and lever arm means carried by said second member for movement therewith and connected to the first and second end portions of said pressure applying means, whereby on movement of the second member away from said second member tensile force is applied simultaneously to both said first and second end portions, increasing the retaining pressure on the cable within the peripheral groove.

2. Powered hoist apparatus as in claim 1, in which said lever arm means includes a bell crank pivotally connected to said eccentric axis and said second disclike member.

3. Powered hoist apparatus as in claim 1, in which there are further provided diverter means including a body portion having an opening extending therethrough aligned with the peripheral grooves in said first disclike member and the roller means grooved peripheries for guiding the cable therebetween.

4. Powered hoist apparatus as in claim 1, in which said pressure applying means includes a roller chain.

5. Powered hoist apparatus as in claim 1, in which said apparatus is mounted in a housing and further includes means attached to said housing via a shear pin for connection with the load which means extends from said housing upon the load exceeding a predetermined maximum for said load shearing said pin.

6. Hoist apparatus for moving a load along a cable or the like, comprising:

a housing;

a first sheave rotatably mounted onto said housing and drivingly interconnected with a rotative power source, the circumference of said sheave being formed into a continuous groove;

a second sheave having a grooved circumference mounted for axial rotation coplanar with said first sheave with its circumferential groove lying opposite that of said first sheave;

at least one peripherally grooved roller rotatably mounted on said second sheave;

means mounting said second sheave to said housing for eccentric swinging movement toward and away from said first sheave;

said cable being received into the groove of said second sheave lying opposite said first sheave and thence engaging the groove of said first sheave over substantially 270° thereof followed by engagement with said roller before exiting from the housing;

flexible chainlike means received over the cable in the first sheave groove; and bell crank means mounted onto said second sheave and interconnected with the ends of said chainlike means, whereby movement of said second sheave with respect to said first sheave varies the engagement force of the chainlike means with the cable.

7. Powered hoist apparatus for moving a load along a cable, comprising:

a first rotatable member drivingly connected to a source of rotative power, said member having a grooved periphery for receiving the cable;

a second rotatable member having a grooved periphery within a part of which the cable is received, said second member being located adjacent the first member in the same plane therewith and arranged for eccentric swinging movement about an axis toward and away from said first member;

elongated pressure applying means received about said first member contacting the cable received within the first member groove having first and second end portions; and a bell crank pivotally connected to said eccentric axis and said second member for movement therewith and connected to the first and second end portions of said pressure applying means, whereby on movement of the second member away from said first member, tensile force is applied simultaneously to both said first and second end portions, increasing the retaining pressure on the cable within the peripheral groove.

8. Powered hoist apparatus as in claim 7, in which there are further provided diverter means including a body portion having an opening extending therethrough aligned with the peripheral groove in said first member, said cable passing through the diverter opening to exit from the hoist apparatus.

9. Powered hoist apparatus as in claim 7, in which said pressure applying means includes a roller chain.

10. Powered hoist apparatus as in claim 7, in which said apparatus is mounted in a housing and further includes means attached to said housing for connection with the load which is shifted upon the load exceeding a predetermined maximum for said load to thereby provide a visual indication of overload.

11. Hoist apparatus for powering a load along a cable or the like, comprising:

a housing;

a first sheave rotatably mounted to said housing and drivingly interconnected with a rotative power source, the circumference of said sheave being formed into a continuous groove;

a second sheave having a grooved circumference mounted for axial rotation coplanar with said first sheave and with its circumferential groove lying opposite that of said first sheave;

means mounting said second sheave to said housing for eccentric swinging movement toward and away from said first sheave;

said cable being received into that portion of the groove of said second sheave lying opposite said first sheave and thence engaging the groove of said first sheave before exiting from the housing;

flexible chainlike means received over the cable in the first sheave groove; and bell crank means pivotally mounted onto said second sheave and having each of its respective ends interconnected with an end of said chainlike means, whereby movement of said second sheave with respect to said first sheave varies the engagement force of the chainlike means with the cable.

12. Hoist apparatus as in claim 11, in which there are further provided diverter means including a body portion having an opening extending therethrough aligned with the peripheral groove in said first sheave and and an exit opening in said housing through which opening the cable passes, said exit opening being offset from the first sheave peripheral groove.

13. Hoist apparatus as in claim 11, in which there are further provided means interconnecting the housing and the load which means are extendible upon the load exceeding a predetermined maximum.

* * * * *